US005197245A

United States Patent [19]

Davis

[11] Patent Number: 5,197,245

[45] Date of Patent: Mar. 30, 1993

[54] STRUCTURAL WALL REINFORCEMENT APPARATUS AND METHOD

[75] Inventor: Edgar A. Davis, San Jose, Calif.

[73] Assignee: VSL Corporation, Campbell, Calif.

[21] Appl. No.: 566,612

[22] Filed: Aug. 13, 1990

[51] Int. Cl.[5] ..... E04B 2/00

[52] U.S. Cl. ..... 52/223 R; 52/249; 52/265; 52/267; 52/300

[58] Field of Search ..... 52/223 R, 300, 249, 52/247, 265, 267, 741

[56] References Cited

U.S. PATENT DOCUMENTS

| | | | |
|---|---|---|---|
| 1,783,383 | 12/1930 | Montrief | 52/300 |
| 2,315,895 | 4/1943 | Crom | 52/249 |
| 4,069,642 | 1/1978 | Hendriks | 52/247 |
| 4,190,993 | 3/1980 | Pohlman et al. | 52/249 |

*Primary Examiner*—Michael Safavi

*Attorney, Agent, or Firm*—Fliesler, Dubb, Meyer & Lovejoy

[57] ABSTRACT

Structural wall reinforcement method and apparatus for reinforcing a wall comprising a plurality of post-tensioned cable assemblies and wire mesh embedded in a layer of concrete-like material for applying compressive forces to the wall.

9 Claims, 5 Drawing Sheets

STRUCTURAL WALL REINFORCEMENT APPARATUS AND METHOD

BACKGROUND OF THE INVENTION

1. Field of the Invention

The present invention relates to structural wall reinforcing apparatus and methods in general and in particular to an apparatus and method for reinforcing brick and block walls.

2. Description of the Prior Art

In years past many buildings and other structures were constructed using brick and blocks as structural wall members but without any interior steel reinforcing rods, bars, or the like, being used for reinforcement as is the current practice.

In the course of powerful seismic activity, e.g. earthquakes, many such unreinforced structures suffer extensive dislocations and damage, if not total destruction.

To preserve such structures and eliminate or significantly reduce the threat of their being damaged during earthquakes, it is necessary to reinforce such structures in a manner which makes them substantially equivalent in strength and soundness to modern-day structures and at a reasonable cost.

SUMMARY OF THE INVENTION

In view of the foregoing, principal objects of the present invention are a method and apparatus for reinforcing a brick and/or block wall structure.

In accordance with the above objects, there is provided a plurality of post-tensioned cable assemblies which are located at selected positions along and attached to the. Each of the cable assemblies is anchored at the base and to the top of the wall and comprises a tendon which runs through a cable duct or grout tube. After the cable assemblies are installed, reinforcing wire mesh is laid across the assemblies and anchored to the wall at selected points by steel dowels embedded in the wall. The cable assemblies and wire mesh are then embedded in a layer of Gunnite or Shotcrete which attaches to the wall by itself or is attached to the wall as by a bonding agent or doweling. After the Gunnite or Shotcrete is cured, the tendons are tensioned and the cable ducts filled with grout. The tensioning of the tendons results in compressive forces being transferred to the wall in such a manner that the resulting composite wall structure is as strong as or stronger than walls constructed originally using current building techniques.

BRIEF DESCRIPTION OF THE DRAWINGS

The above and other objects, features and advantages of the present invention will become apparent from the following detailed description of the accompanying drawings, in which.

DETAILED DESCRIPTION OF THE INVENTION

Figure 1:
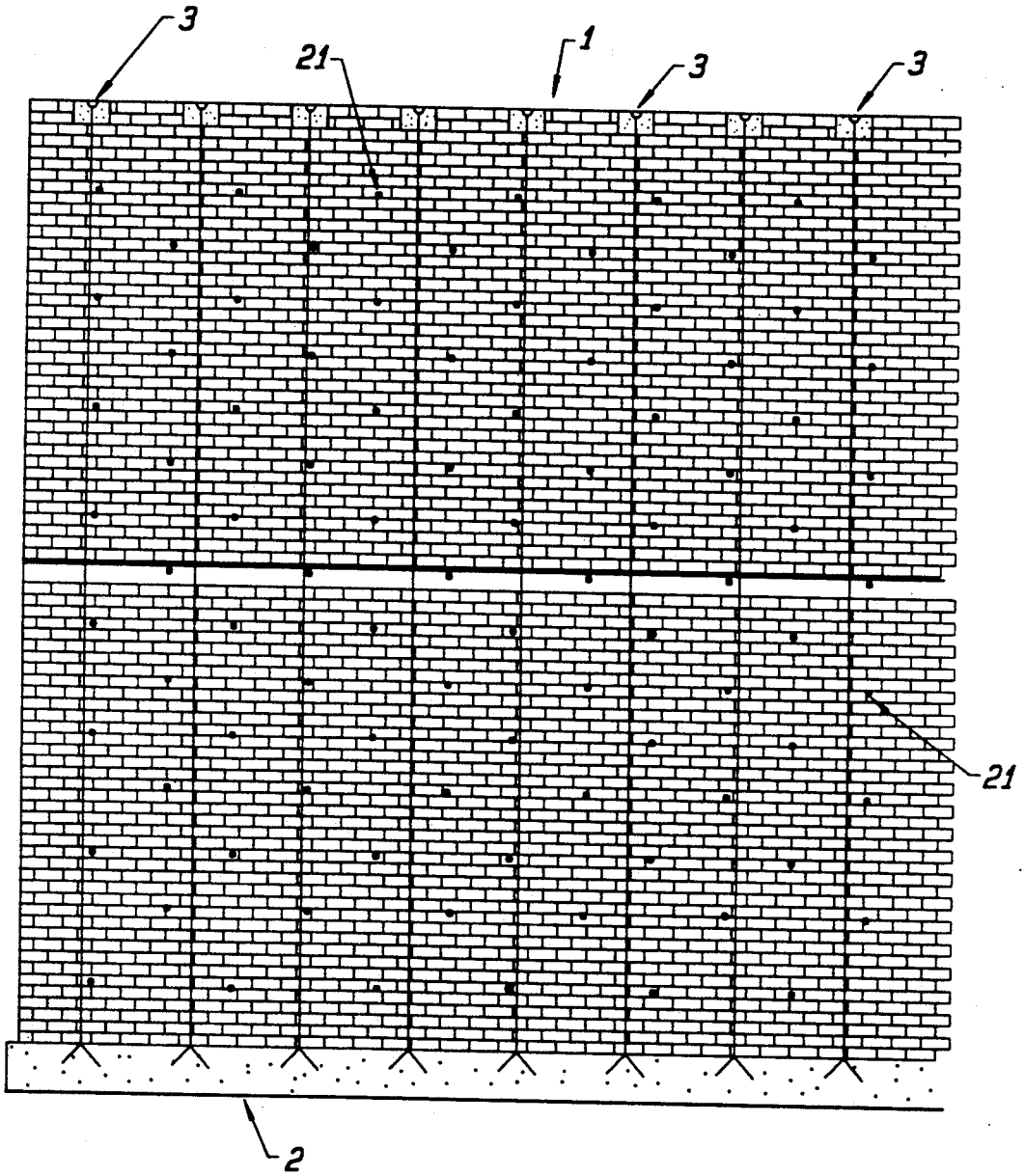
FIG. 1 is a front elevation view of a brick wall reinforced with cable assemblies according to the present invention.

Referring to FIG. 1, there is shown an elevation view of an unreinforced brick wall designated generally as 1 which is built on a foundation 2. Attached at selected locations across the face of the wall 1 there is provided a plurality of cable assemblies 3.

Figure 3:
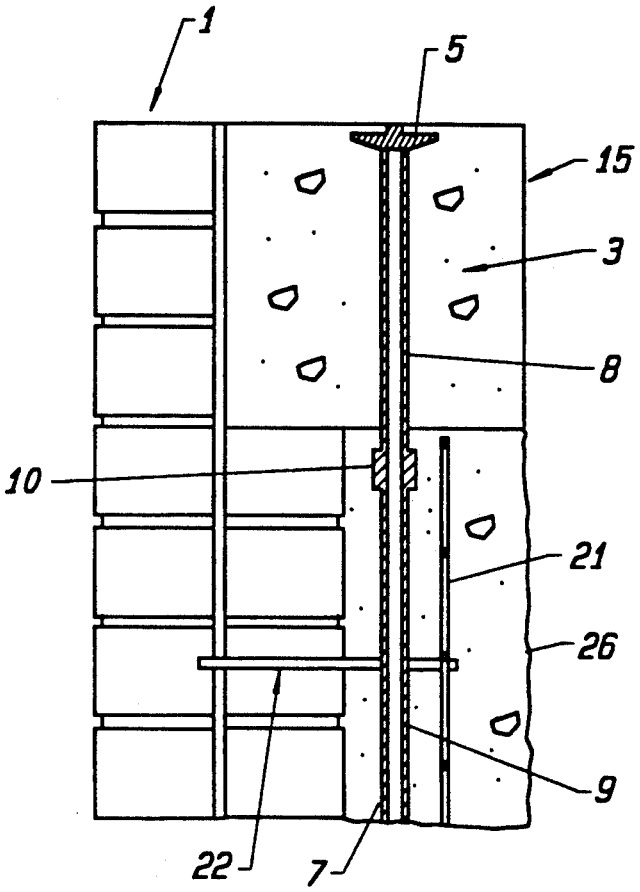
FIG. 3 is a side elevation view showing the installation of an upper anchor plate and wire mesh according to the present invention.
Figure 2:
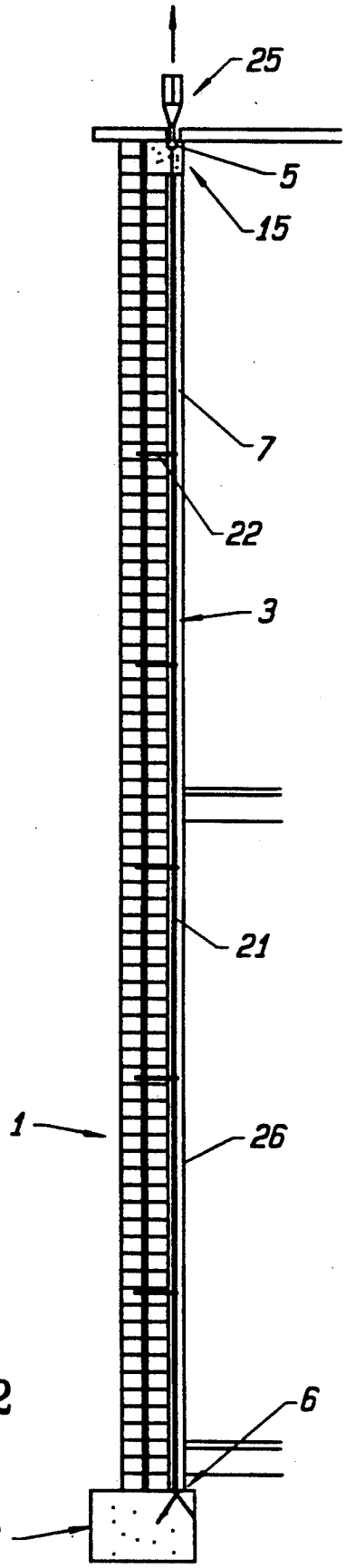
FIG. 2 is a side elevation view of a section of the wall of FIG. 1.
Figure 4:
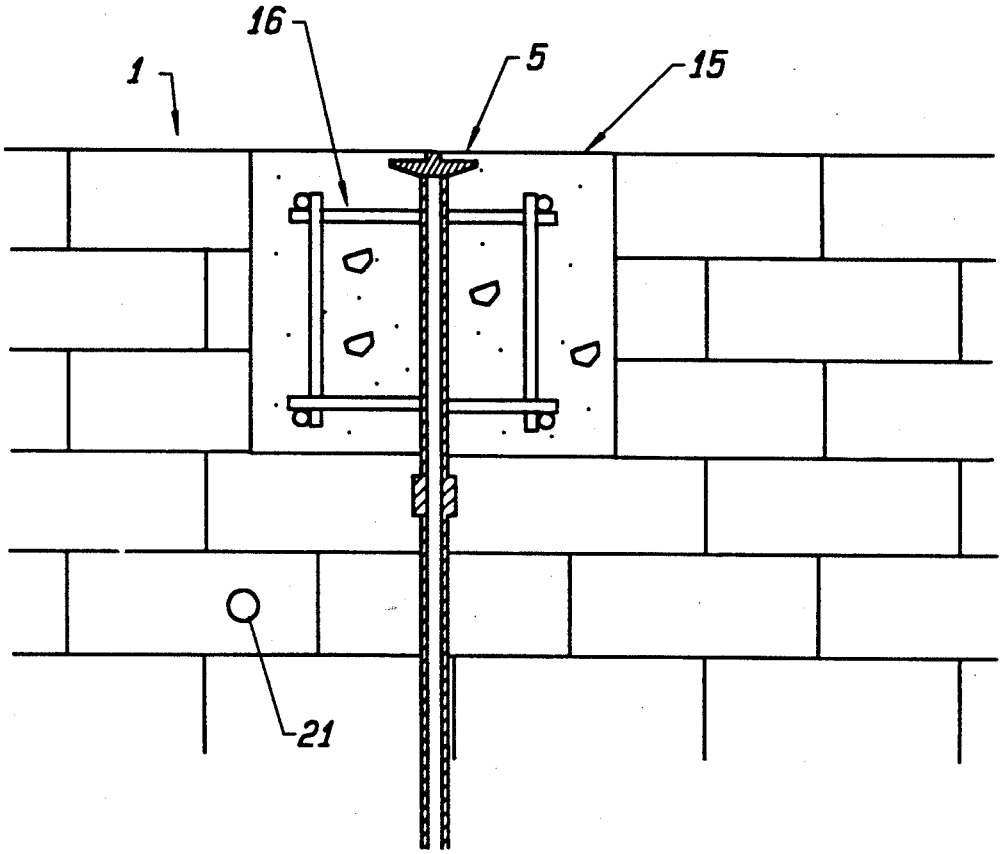
FIG. 4 is a front elevation view of FIG. 3 with the wire mesh omitted for clarity.
Figure 6:
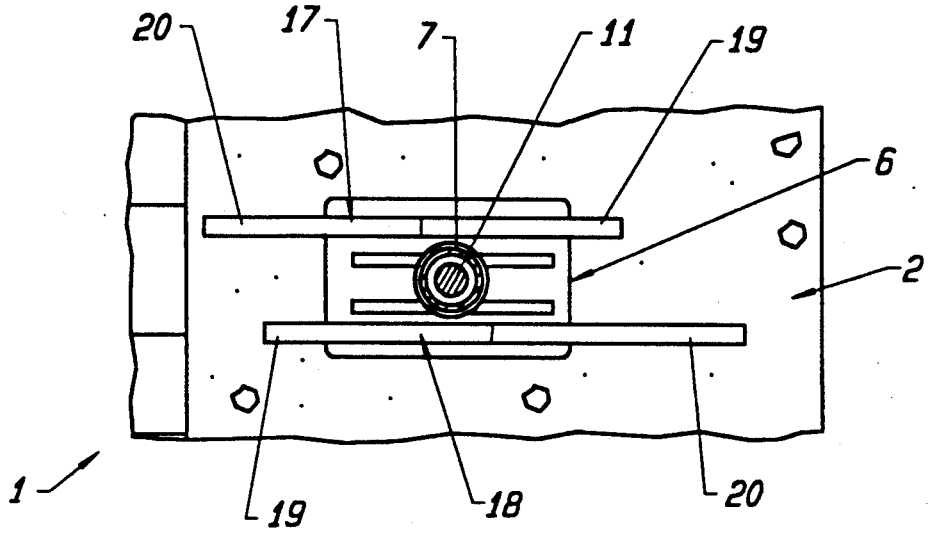
FIG. 6 is a top plan view of FIG. 5.
Figure 5:
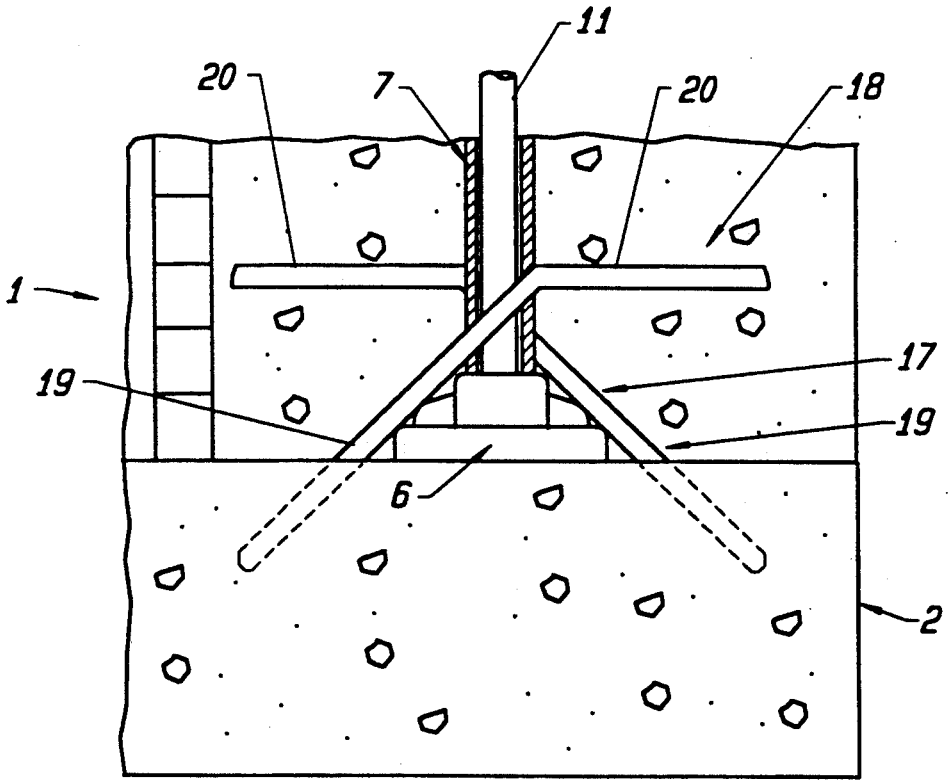
FIG. 5 is a side elevation view of a lower anchor plate, i.e. footing anchor, showing the manner in which the lower anchor plate of the cable assemblies are anchored to a wall foundation using footing anchor dowels according to the present invention.

Referring to FIGS. 2–6, there is provided in each of the cable assemblies 3 an upper anchor plate 5 and a lower anchor plate 6. Extending between the upper anchor plate 5 and lower anchor plate 6 there is provided a cable duct 7, also called a grout tube, comprising an upper duct section 8 and a lower duct section 9 which are joined by a coupling 10. The duct 7 is provided for enclosing a tendon 11, as shown in FIGS. 5 and 6. The upper end of the tendon 11 is anchored in the anchor plate 5 and the lower end of the tendon 11 is anchored in the anchor plate 6 by means of clamping wedges (not shown). The clamping wedges grasp the tendon in a well known manner so as to maintain the tendon under tension, as will be further described below.

Referring in particular to FIGS. 3 and 4, the upper anchor plate 5 and the upper section 8 of the cable duct 7 are embedded in a square block of concrete 15. For added strength a plurality of reinforcing bars 16, which are joined at their intersecting points, are also embedded in the concrete block 15, as shown more clearly in FIG. 4. During its construction, the block 15 is rigidly attached to at least a portion of the top of the wall 1 so as to impart compressive forces thereto, as will be further described below.

Referring to FIGS. 5 and 6, the lower anchor plate 6 is mounted on the foundation 2 which extends beneath the wall 1. If a foundation similar to foundation 2 does not exist in the original construction of the wall 1, a foundation 2 is poured and a rigid connection made in any suitable manner with the original foundation.

To secure the lower anchor plate 6 to the foundation 2 there is provided a plurality of segments of reinforcing bar 17 and 18. Reinforcing bar segments 17 and 18 comprise a lower section 19 and an upper horizontal section 20. The lower sections 19 are embedded in the foundation 2 and rigidly affixed thereto by means of an adhesive epoxy, or the like.

In practice, the segments 17 and 18 are arranged to extend over the anchor plate 6 so as to capture the anchor plate 6 between the segments 17 and 18 and the foundation 2.

Referring again to FIGS. 2 and 3, after the cable assemblies 3 are anchored to the top and bottom of the wall 1, wire mesh 21 is placed across the face of the wall 1 and attached thereto as by a plurality of dowels 22 which are rigidly attached, as by epoxy or the like, in holes provided therefor in the wall 1.

After the cable assemblies 3 and wire mesh 21 are mounted to the wall 1 and foundation 2, the adjacent surface of the wall 1 is sandblasted and coated with an adhesive, such as an epoxy. Thereafter, a concrete-like material, typically known under the trade name Gunnite or Shotcrete, is applied over the wall between the lower surface of the concrete block 15 and the upper surface of the foundation 2 for embedding the exposed portion of the cable assemblies 3 and the wire mesh 21. As is well known, Gunnite or the like has substantially the same or greater compressive strength as does the brick typically used in the wall 1.

After the Gunnite is cured, a jack 25 is coupled to the upper end of the tendon 11 for applying tensile force to the tendon 11. After a desired amount of tensile force is applied to the tendon 11, e.g. 6,000 pounds, a relaxation of the tensile force will cause the wedge-shaped clamping members in the upper anchor plate 5 to grasp the upper end of the tendon 11, maintaining the tendon 11 under tension. This tension is then transmitted via the block 15 to the wall 1, placing the wall 1 under compression.

Figure 7:
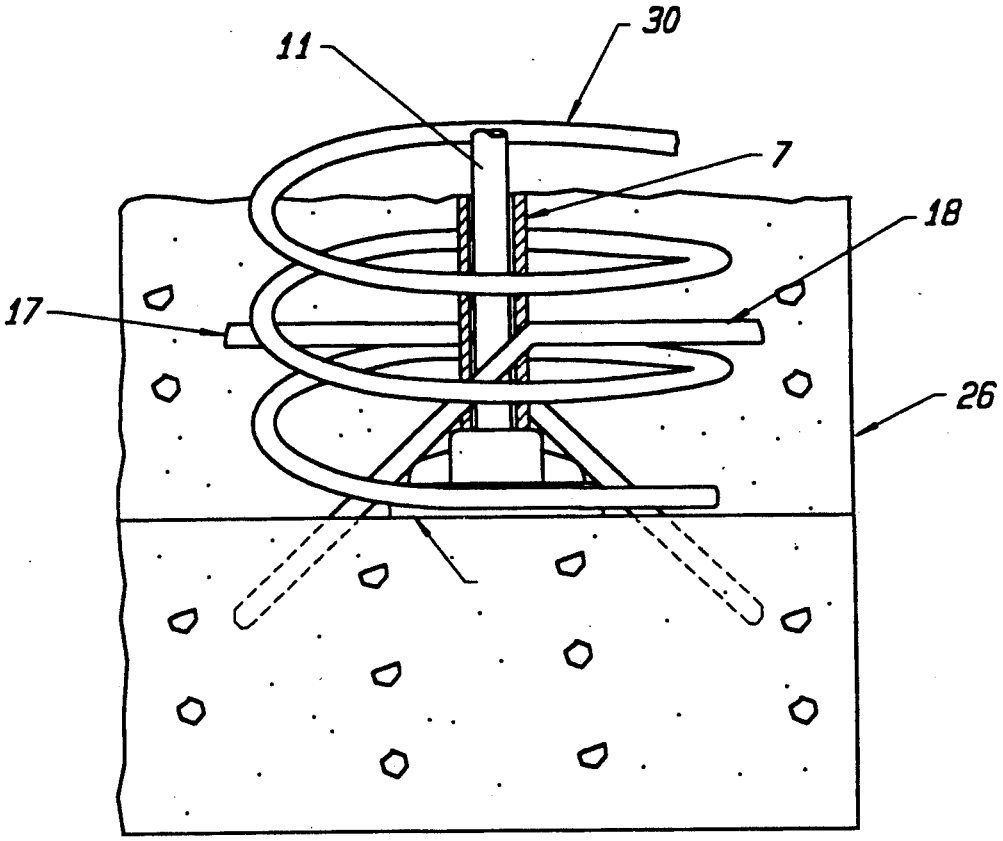
FIG. 7 is an alternative view of the footing anchor comprising a spiral rebar cage tied to the footing anchor dowels according to the present invention.

Referring to FIG. 7, there is provided in an alternative embodiment of the present invention a spiral rebar cage designated generally as 30. Cage 30 is placed around the footing anchor rebar 17 and 18 and tied thereto in a conventional manner before being embedded in the Gunnite 26.

In a typical embodiment of the present invention, the dowels 21, the rebar sections 16, 17 and 18, typically comprise No. 4 or No. 5 rebar. The layer of Gunnite 26 is typically 4–6 inches thick and the block 15 is typically an 8–10 inch square block. After the tendon is tensioned, grout is forced into the duct 7 in a conventional manner so as to protect the tendon 11 from corrosion.

While a preferred embodiment of the present invention is described above, it is contemplated that various modifications may be made thereto without departing from the spirit and scope of the present invention. Accordingly, it is intended that the embodiment described be considered only as an illustration of the present invention and that the scope thereof should not be limited thereto but be determined by reference to the claims hereinafter provided and their equivalents.

What is claimed is:

1. A structure for reinforcing a brick or block wall or the like comprising:

a plurality of cable assemblies, each of said cable assemblies comprising a lower anchor plate, an upper anchor plate, a cable duct which extends between said lower and said upper anchor plates and a tendon which extends through said cable duct having an upper end anchored in said upper anchor plate and a lower end anchored in said lower anchor plate, said upper anchor plate comprising means for allowing said tendon to be placed under tension;

reinforcing wire mesh;

means for anchoring said wire mesh to said wall at selected positions in such a manner that said plurality of cable assemblies is located between said wire mesh and said wall; and means for vertically anchoring each of said plurality of cable assemblies to said wall at selected positions thereon, said means for anchoring said cable assemblies comprising a block of concrete-like material in which said upper anchor plate is embedded, a portion of which rests on and is rigidly affixed to at least a portion of said wall, a plurality of segments of reinforcing bar having lower end portions thereof which are embedded in and rigidly attached to a foundation underlying said wall and upper portions thereof which extend over the top of said lower anchor plate, and a layer of concrete-like material which extends between said block of concrete-like material and said foundation for embedding said cable assemblies, said wire mesh, said lower anchor plate and said upper portions of said reinforcing bar.

2. A structure according to claim 1 wherein said block of concrete-like material comprises a plurality of segments of reinforcing bar for reinforcing said block of concrete-like material.

3. A structure according to claim 1 comprising means for affixing said layer of concrete-like material to said wall.

4. A structure according to claim 3 wherein said affixing means comprises an epoxy-like material.

5. A method of reinforcing a brick or block wall or the like comprising the steps of:

providing a plurality of cable assemblies, each of said cable assemblies comprising a lower anchor plate, an upper anchor plate, a cable duct which extends between said lower and said upper anchor plates and a tendon which extends through said cable duct having an upper end anchored in said upper anchor plate and a lower end anchored in said lower anchor plate, said upper anchor plate comprising means for allowing said tendon to be placed under tension;

providing reinforcing wire mesh;

anchoring said wire mesh to said wall at selected positions in such a manner that said plurality of cable assemblies is located between said wire mesh and said wall;

vertically anchoring each of said plurality of cable assemblies to said wall at selected positions thereon, said step of anchoring each of said cable assemblies comprising the steps of embedding said upper anchor plate in a block of concrete-like material;

rigidly attaching said block to said wall;

embedding and rigidly attaching the lower end of a plurality of reinforcing bars in a foundation which extends beneath said wall such that the upper ends of said bars pass over said lower anchor plate forming a footing anchor; and embedding said cable assemblies including said lower anchor plates, said wire mesh and said upper ends of said reinforcing bars between said block of concrete-like material and said foundation in a layer of concrete-like material.

6. A method according to claim 5 further comprising the steps of:

tying a spiral cage of reinforcing bar to said plurality of reinforcing bars embedded in said foundation for providing added reinforcement to said footing anchor.

7. A method according to claim 5 wherein said step of embedding said upper anchor plate in a block of concrete-like material comprises the step of inserting a plurality of segments of reinforcing bar in said block for reinforcing said block.

8. A method according to claim 5 comprising the step of affixing said layer of concrete-like material to said wall.

9. A method according to claim 8 wherein said affixing step comprises the step of affixing said layer with an epoxy-like material.

* * * * *